United States Patent [19]

Sakamoto et al.

[11] Patent Number: 4,675,156

[45] Date of Patent: Jun. 23, 1987

[54] STRUCTURAL AUSTENITIC STAINLESS STEEL WITH SUPERIOR PROOF STRESS AND TOUGHNESS AT CRYOGENIC TEMPERATURES

[75] Inventors: Setsu Sakamoto; Yasuhiro Nakagawa; Isamu Yamauchi, all of Tokyo; Takashi Zaizen; Katsumi Suzuki, both of Nagoya; Susumu Shimamoto; Hideo Nakajima, both of Ibaraki, all of Japan

[73] Assignees: Nippon Steel Corporation; Japan Atomic Energy Research Institute, both of Tokyo, Japan

[21] Appl. No.: 765,927

[22] Filed: Aug. 15, 1985

[30] Foreign Application Priority Data

Aug. 20, 1984 [JP] Japan ..... 59-172684

[51] Int. Cl.[4] ..... C22C 38/58

[52] U.S. Cl. ..... 420/34; 420/43; 420/44; 420/56; 420/59; 420/65; 420/584

[58] Field of Search ..... 75/128 A, 128 N, 124 R, 75/124 C; 420/584, 44, 59, 119, 120, 128; 148/38

[56] References Cited

U.S. PATENT DOCUMENTS 4,172,716 10/1979 Abo et al. ..... 75/128 A

FOREIGN PATENT DOCUMENTS 50-8967 4/1975 Japan .
51-18916 2/1976 Japan .
193347 11/1983 Japan .
59-64752 4/1984 Japan ..... 75/124

*Primary Examiner*—Melvyn J. Andrews
*Assistant Examiner*—Deborah Yee
*Attorney, Agent, or Firm*—Pollock, Vande Sande & Priddy

[57] ABSTRACT

Disclosed is a structural austenitic stainless steel with superior proof stress and toughness at cryogenic temperatures. The steel has a composition essentially consisting of, by weight, not greater than 0.05% of carbon, 0.20 to 0.70% of nitrogen, not greater than 1.0% of silicon, not greater than 25% of manganese, 13 to 35% of chromium, 5 to 25% of nickel and the balance substantially iron. The chromium content and manganese content is selected to meet the condition of (Cr+0.9 Mn)≧20%. The index of cleanliness showing the amount of nonmetallic inclusions is not greater than 0.1%.

10 Claims, 5 Drawing Figures

STRUCTURAL AUSTENITIC STAINLESS STEEL WITH SUPERIOR PROOF STRESS AND TOUGHNESS AT CRYOGENIC TEMPERATURES

BACKGROUND OF THE INVENTION

The present invention relates to an austenitic stainless steel for a cryogenic structure. More particularly, the invention is concerned with a stable austenitic stainless steel which exhibits superior proof stress and toughness when used at very low temperatures between 4° K. at which helium is in liquid phase and 111° K. which is LNG temperature.

Nowadays, there is an increasing demand for structural materials capable of withstanding uses at very low temperatures, such as the materials of LNG tanks and pipes, liquid hydrogen fuel containers for rockets, superconductive magnets which have to be used at liquid helium temperature, and so forth. In view of the current changing of energy resources, it is believed that the use of such structural materials will be drastically increased and spread in the near future to cope with demands in various apparatus such as nuclear fusion apparatus, linear motor cars, superconductive generators, and so forth.

The structural materials for use at very low temperatures have to meet various requirements. First of all, it is essential that the materials do not exhibit brittle fracture at a very low temperature at which the materials are used. High strength and high proof stress are also important requisites. When the materials are used for superconductive magnets, they must be non-magnetic.

Austenitic stainless steels, which can maintain good ductility even at very low temperatures, are capable of being used as materials for use at cryogenic temperatures and actually have been used in certain fields. Unfortunately, however, the known austenitic stainless steels exhibit only low levels of proof stress at cryogenic temperatures and, hence, are unsatisfactory from the view point of strength.

It is well known that the proof stress can be improved most effectively by addition of nitrogen, and nitrogen-containing austenitic stainless steels have been put into practical use already. The improvement in the proof stress becomes more remarkable as the amount of addition of nitrogen is increased and as the temperature of use becomes lower. It has been reported, however, the addition of nitrogen imposes another problem in that the low-temperature toughness is decreased and, therefore, nitrogen-containing austenitic stainless steels such as SUS 304LN, SUS 316LN and so forth, containing only up to 0.20% of nitrogen, have been used practically. The high proof stress essential for use at very low temperatures cannot be attained with such a small nitrogen content. Recently, therefore, alternative steel materials such as high-manganese austenitic steel are attracting attention as being promising structural materials for use at cryogenic temperatures.

The present inventors have found that a perfectly non-magnetic stable austenitic stainless steel meeting the following conditions can be used satisfactorily as the structural materials for use at cryogenic temperature: namely, proof stress not smaller than 1000 Mpa (Mega Pascal) at 4° K. and a high toughness not smaller than 100 J (Joule) in terms of energy absorption by V-notch Charpy test at 4° K.; and proof stress not smaller than 700 Mpa at 77° K. and toughness of not smaller than 120 J by V-notch Charpy test at 77° K.

FIG. 1 shows the relationship between nitrogen content (wt %) and 0.2% proof stress in an austenitic stainless steel consisting, by weight, of 0.20% of C, 0.8% of Si, 1.0% of Mn, 25% of Cr, 13% of Ni and the balance Fe. From this Figure, it will be understood that the nitrogen content has to be at least 0.20%, in order to obtain a proof stress not smaller than 1000 Mpa at 4° K.

FIG. 2 shows the relationship between nitrogen content and 0.2% proof stress in an austenite stainless steel consisting, by weight, of 0.02% of C, 0.8% of Si, 5% of Mn, 22% of Cr, 13% of Ni, and the balance Fe. It will be seen from this Figure that the nitrogen content must be at least 0.20%, in order to obtain a proof stress not smaller than 700 Mpa at 77° K.

The proof stress at cryogenic temperature will be increased by increasing the nitrogen content. Actually, however, there is a limit in the solid-solubility of nitrogen. In the case of austenite stainless steels, the solid-solubility of nitrogen is limited to 0.2% and 0.3%, respectively, when chromium content is 20% and 25%. For obtaining a high nitrogen stainless steel having a proof strength not smaller than 1000 Mpa at 4° K. and proof strength not smaller than 700 Mpa at 77° K., the chromium content has to be at least 20%. It is thus possible to obtain proof stress required for structural materials for use at cryogenic temperatures, by adding a large amount of nitrogen, as is well known. The addition of nitrogen into an austenite stainless steel, however, undesirably causes a drastic reduction in the toughness value in low temperature, so that the stainless steel becomes brittle at low temperatures and, therefore, it has been considered difficult to put such high nitrogen austenitic stainless steel into practical use.

For instance, Japanese Post-Exam Patent Publication No. 24364/1979 discloses an austenite stainless steel rich in nitrogen, which contains, as basic components, 0.001 to 0.20% of C, 0.1 to 6.0% of Si, 0.1 to 10.0% of Mn, 15.0 to 35.0% of Cr, 3.5 to 22.0% of Ni, 0.01 to 6.0% of Mo and 0.001 to 0.5% of N, the steel further containing 0.01 to 0.07% of Al and 0.001 and 0.02% of Ca, while meeting the condition of $Cr+Ni+Mo+Si \geqq 22.5\%$.

This steel has been developed for attaining such properties as having a good hot-workability, little in flaw, superior in pitting resistance in sea water and high heat resistance at around 800° C., however, this steel is not intended for use as the structural materials for use at cryogenic temperatures as low as 4° K.

SUMMARY OF THE INVENTION

Accordingly, an object of the invention is to provide a stable structural austenitic stainless steel for use at cryogenic temperatures, which exhibits both high proof stress and high toughness at cryogenic temperatures and which is non-magnetic.

The present inventors have found that the reduction in the toughness at low temperature is not attributable to the addition of nitrogen but to the presence of second phases such as inclusions, precipitates, δ-ferrite, martensite and so forth. Namely, nitrogen existing in solid-solution state in a steel does not substantially degrades the low-temperature toughness, while a significant reduction in the low-temperature toughness occurs when at least one of the following conditions (1) to (3) is met: (1) where precipitation occurs in the form of compound of nitrogen and other element, (2) where there is a large quantity of inclusions, and (3) where δ-ferrite or martensite has been formed. That is, it has been erroneously understood by those skilled in the art that the deterioration in the low-temperature toughness in the austenite stainless steel is attributable to the presence of solid-solution of nitrogen.

Thus, the present inventors have found for the first time that a nitrogen-containing austenitic stainless steel having superior strength and proof stress will be obtained if the composition of the stainless steel is selected to prevent the conditions (1) to (3) mentioned above from occurring.

The condition (1) mentioned above can be prevented by adjusting the nitrogen content in relation to other elements such that the nitrogen content is below the solid-solubility limit and by subjecting the stainless steel to a well-known heat treatment under such a condition as not to allow precipitation of nitrogen.

For preventing the condition (2), it is essential that the amount of non-metallic inclusions is well controlled.

The prevention of the condition (3) mentioned above requires not only the absence of δ-ferrite but also a perfect austenite stability having a value not greater than 1.02 in relative permeability so that the martensite transformation may not be induced even under severe working condition at very low temperature of use. Such a material also is perfectly non-magnetic and can be used quite advantageously as the material of, for example, superconductive magnet.

As a result of many experiments as to the deterioration of low-temperature toughness caused by the condition (2) mentioned above, i.e., presence of large quantity of inclusions, the inventors have found the following facts:

(1) Among the non-metallic inclusions and precipitates, both inclusion of and precipitate of oxide including Al cause the deterioration of low-temperature toughness most seriously, and the low-temperature toughness can be improved remarkably by minimizing the Al content and by changing precipitated Al into solid-solution Al through a suitable heat treatment. The inventors have found also that the larger the atomic ratio N/Al between N and Al becomes, the more low-temperature toughness is improved. The inventors have experimentally confirmed through electron-microscopic observation, EDX and inclusion analysis that the low-temperature impact toughness becomes lower as the contents of $Al_2O_3$ and AlN become higher, and that the inclusions having large sizes, polygonal and/or elongated shapes are not preferred as compared with spherical ones, because such inclusions seriously affect the low-temperature impact toughness.

To this end, according to an aspect of the invention, there is provided a structural austenitic stainless steel with superior proof stress and toughness at cryogenic temperatures having a composition essentially consisting of, by weight, not greater than 0.05% of carbon (C), 0.20 to 0.70% of nitrogen (N), not greater than 1.0% of silicon (Si), not greater than 25% of manganese (Mn), 13 to 35% of chromium (Cr), 5 to 25% of nickel (Ni) and the balance substantially iron (Fe), the chromium content and manganese content being selected to meet the condition of $(Cr+0.9\ Mn) \geqq 20\%$, the index of cleanliness showing the amount of non-metallic inclusions in the steel being not greater than 0.1%.

The invention in its another aspect provides a structural austenitic stainless steel with superior proof stress and toughness at cryogenic temperatures having a composition essentially consisting of, by weight, not greater than 0.05% of carbon (C), 0.20 to 0.07% of nitrogen (N), not greater than 1.0% of silicon (S), not greater than 25% of manganese (Mn), 13 to 35% of chromium (Cr), 5 to 25% of nickel (Ni), not greater than 0.07% of total Al, and the balance substantially iron (Fe), the chromium content and manganese content being selected to meet the condition of $(Cr+0.9\ Mn) \geqq 20\%$, the atomic ratio N/Al between nitrogen and aluminum being not smaller than 10, the index of cleanliness showing the amount of no-metallic inclusions in the steel being not greater than 0.1%.

Preferably, the structural austenitic stainless steel of the invention for use at cryogenic temperatures has substantially non-magnetic property in which the value of relative magnetic permeability is not more than 1.02.

A description will be made hereinunder as to the reasons of limitation of the contents of respective elements.

The carbon as an austenite stabilizer tends to be combined with chromium to form carbides which undesirably deteriorates the toughness. The carbon content, therefore, be limited to be not greater than 0.05%.

Addition of nitrogen is essential for obtaining high proof stress at very low temperatures. For obtaining an appreciable effect, the nitrogen content should be at least 0.20%. An increase in the nitrogen content increases the proof stress. However, the content of nitrogen in excess of 0.70% in super-solid-solution state is difficult to obtain, and the presence of nitrogen in the form of precipitates does not materially contribute to improvement in the low-temperature proof stress. Rather, such precipitates deteriorates the toughness undesirably. For this reason, the nitrogen content should be limited to be not greater than 0.70%. The nitrogen content, preferably, ranges between 0.25 and 0.5%.

Silicon is an element which is essential for deoxidation in the course of steel making. This element, however, serves as a ferrite stabilizer and, when its content exceeds 1.0%, hinders the formation of stable austenite structure. For this reason, silicon content is limited such as not to exceed 1.0%.

Manganese serves to increase the solid-solubility of nitrogen as is the case of chromium. In order to allow a large quantity of nitrogen to be contained in the form of solid solution, the addition of manganese is quite effective. The solid-solubility of nitrogen, however, is saturated at the level of 0.70%, even if the manganese content is increased beyond 25%. For this reason, the manganese content is limited to be not greater than 25%. Preferably, the manganese content is selected to range between 1 and 15%, most preferably between 2 and 10%.

Chromium is an element which serves to increase the amount of solid-solution of nitrogen, as is the case of manganese. In addition, this element provides a higher corrosion resistance to stainless steel. For obtaining an appreciable effect of addition of chromium, the chromium content should be at least 13%. The solid-solubility of nitrogen is increased as the chromium content is increased. However, since chromium is a ferrite stabilizer, it is necessary to increase the nickel content in accordance with an increase in the chromium content, in order to maintain a stable austenite structure. An excessive increase in the nickel content, however, produces a ferromagnetic property of the steel at very low temperatures. An increase of chromium also causes manganese to change from an austenite stabilizer to a ferrite stabilizer, resulting in a greater tendency of formation of intermetallic compounds such as δ-phases etc. which in turn deteriorate the toughness. Taking these facts into account, the upper limit of the chromium content is limited to be 35%. Thus, the chromium content in the steel of the invention is limited to be 13 to 35%, preferably 15 to 28%. In order to allow nitrogen to exist in the form of solid solution in excess of 0.20%, it is necessary that the chromium content and the manganese content are selected to meet the condition of $Cr+0.9\ Mn \geqq 20\%$. More preferably, the sum (Cr+0.9 Mn) ranges between 25 and 35%.

Nickel is an element which is essential for stabilization of austenite, and the nickel content is determined in view of balance with the chromium content. However, since the steel of the invention contains nitrogen which also serves as an austenite stabilizer, the nickel content in the steel of the invention needs not be so high as compared with that in ordinary stainless steels containing no nitrogen. The results of experiments conducted by the present inventors show that, in order to obtain austenite structure which is stable even at low temperatures, the steel of the invention should contain not less than 5% of nickel. A nickel content exceeding 25% causes a risk of imparting ferromagnetic property to the steel at very low temperatures. For these reasons, the nickel content is selected to range between 5 and 25%, preferably between 8 and 18%.

The contents of other elements should be made as small as possible because such elements undesirably increases the contents of inclusions and precipitates. In particular, total aluminum content should be limited such as not to exceed 0.07%.

In regard to the total aluminum content, attention must be drawn to FIG. 4 which shows the relationship between the aluminum content and V-notch Charpy impact absorption energy at 77° K. and 4° K., respectively, as observed with a stainless steel consisting of 0.03% of carbon, 0.15 to 0.51% of nickel, 0.8% of silicon, 1.0% of manganese, 25% of chromium and 13% of nickel and the balance iron. From this Figure, it will be seen that Al content has a close correlation to the value of impact energy absorption and that, in order to obtain a sufficiently high toughness exceeding 100 J at 4° K., it is necessary to limit the total aluminum content to be not greater than 0.07%. In other words, the required impact energy absorption of 100 J at 4° K. cannot be obtained if the total aluminum content exceeds 0.07%. For this reason, the total aluminum content is limited to be not more than 0.07%.

In the present invention, it is also preferred that the atomic ratio N/Al be maintained to be not smaller than 10, as will be understood from the following explanation made in conjunction with FIG. 5. Namely, FIG. 5 shows the relationship between atomic ratio N/Al of nitrogen to aluminum and the value of impact energy absorption at 4° K. as observed with the same alloy composition as that explained in connection with FIG. 4. From this Figure, it will be understood that the ratio N/Al should take a value exceeding 10, in order to obtain a large absorption energy value of 100 J or greater.

The composition as explained hereinabove provides a stable austenite structure capable of exhibiting a high proof stress at cryogenic temperatures. This composition, however, cannot provide sufficient toughness at cryogenic temperatures, unless the amounts of non-metallic inclusions and precipitates are suitably controlled.

FIG. 3 shows the relationship between the amount of non-metallic inclusions and V-notch Charpy impact absorption energy at 4° K. and 77° K., in a steel consisting of 0.02% of C, 0.35% of N, 0.8% of Si, 1.0% of Mn, 25% of Cr, 1.3% of Ni, and the balance Fe. From this Figure, it will be clearly understood that the amount of non-metallic inclusions is closely correlated to the impact absorption energy, and that, in order to obtain sufficient toughness value at very low temperatures, the index of cleanliness has to be 0.1% or less as measured by a method specified in JIS (Japanese Industrial Standard) G 055 "microscopic testing method for non-metallic inclusions in steel".

For information, JIS G055 reads "By the total number of grating points found on a glass plate within a visual field, the number of visual field, and the number of grating points occupied by inclusions, the percentage of area occupied by the inclusions shall be calculated from the following formula and the index of cleanliness of the steel (d %) shall be determined.

$$d = \frac{n}{p \times f} \times 100$$

where p: total number of grating points on the glass plate in the visual fluid f: number of the visual fields n: number of grating points occupied by the inclusions through the visual fields numbering f"

Namely, any cleanliness exceeding 0.1% cannot provide the desired impact energy absorption which is 100 J at 4° K. It is, therefore, essential that the index of cleanliness of non-metallic impurities be maintained not greater than 0.1%.

DESCRIPTION OF THE PREFERRED EMBODIMENTS

Figure 1:
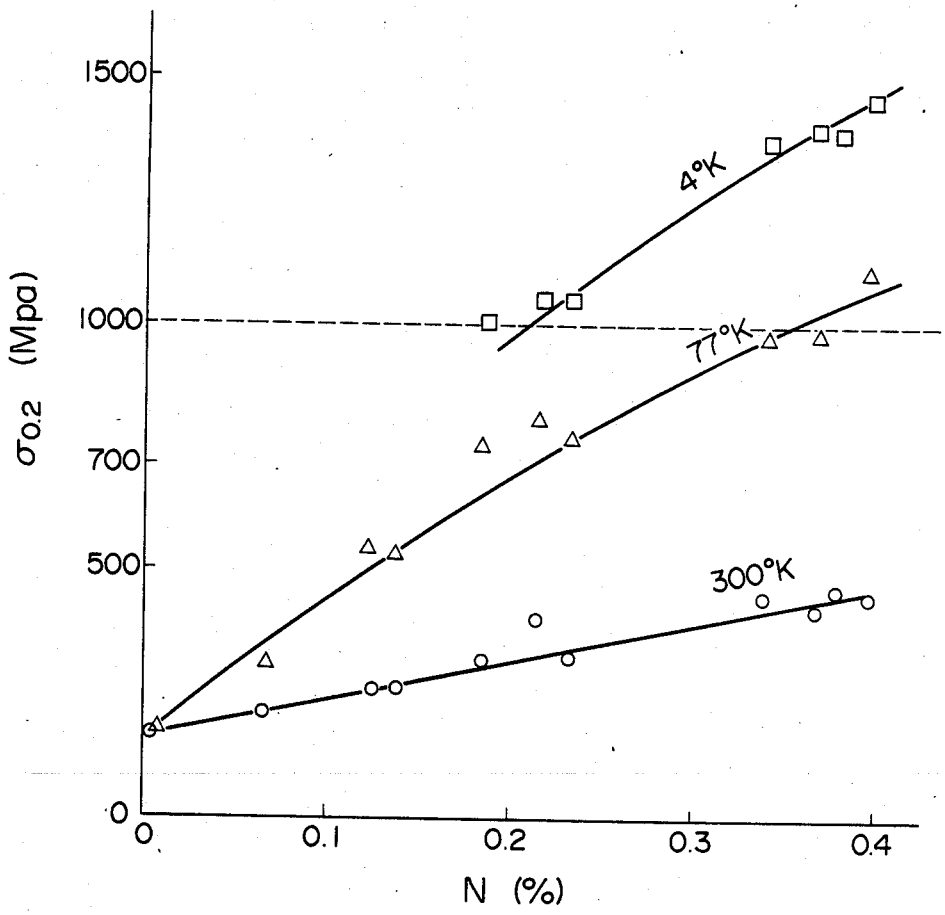
FIGS. 1 and 2 are graphs which show how the proof stress in austenitic stainless steel is improved by addition of nitrogen.
Figure 2:
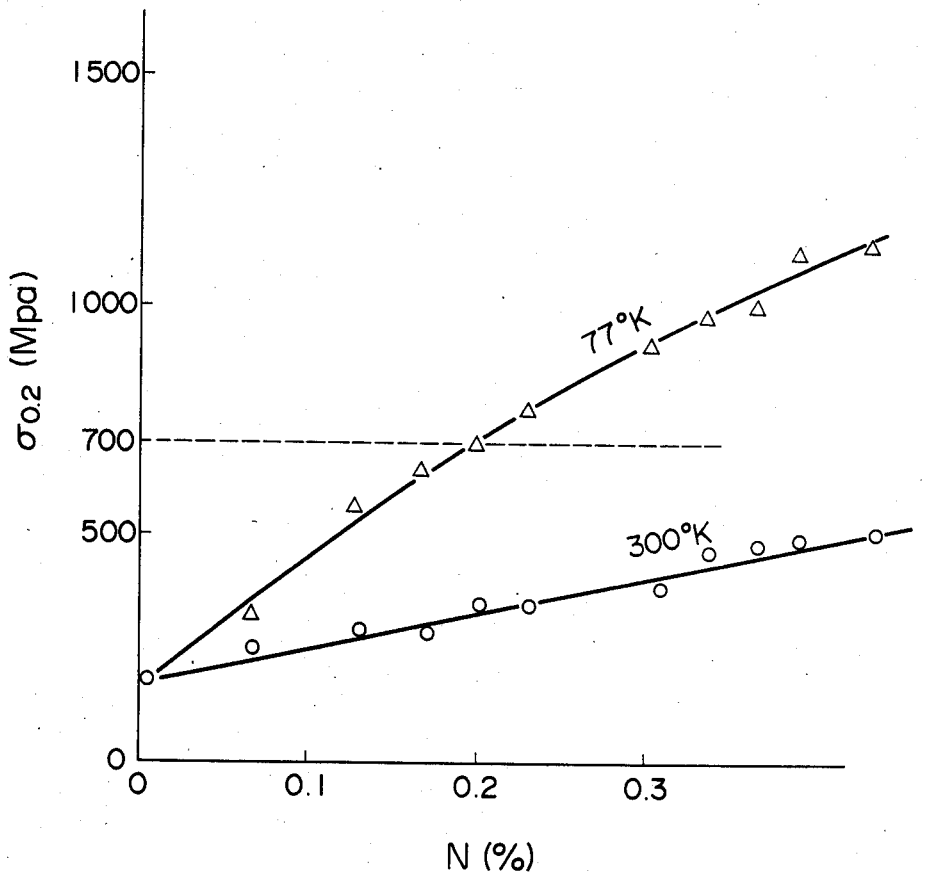
Figure 3:
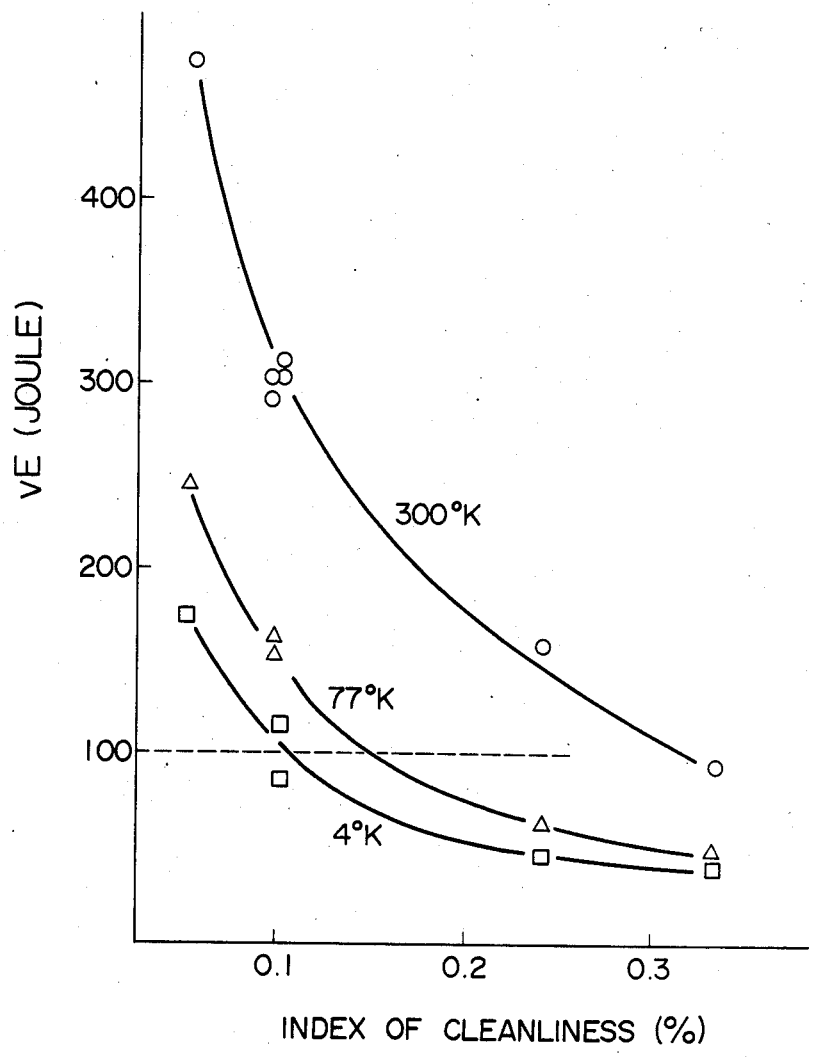
FIG. 3 is a graph showing a relationship between the value of V-notch Charpy impact energy absorption and amount of non-metallic inclusions with respect to a stable austenitic stainless steel.
Figure 4:
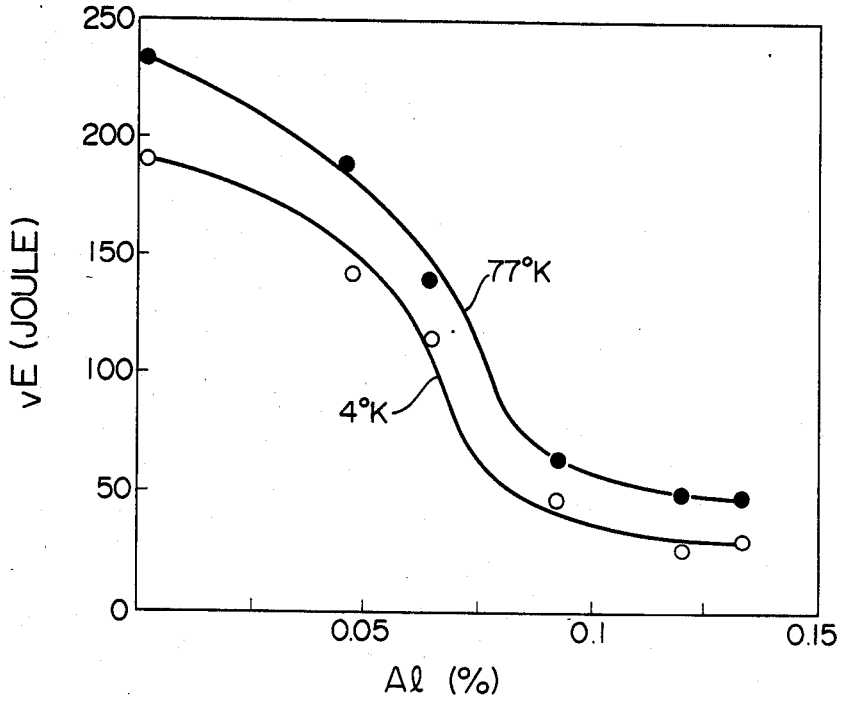
FIG. 4 is a graph showing the relationship between the values of impact energy absorption at 4° K. and 77° K. and aluminum content.
Figure 5:
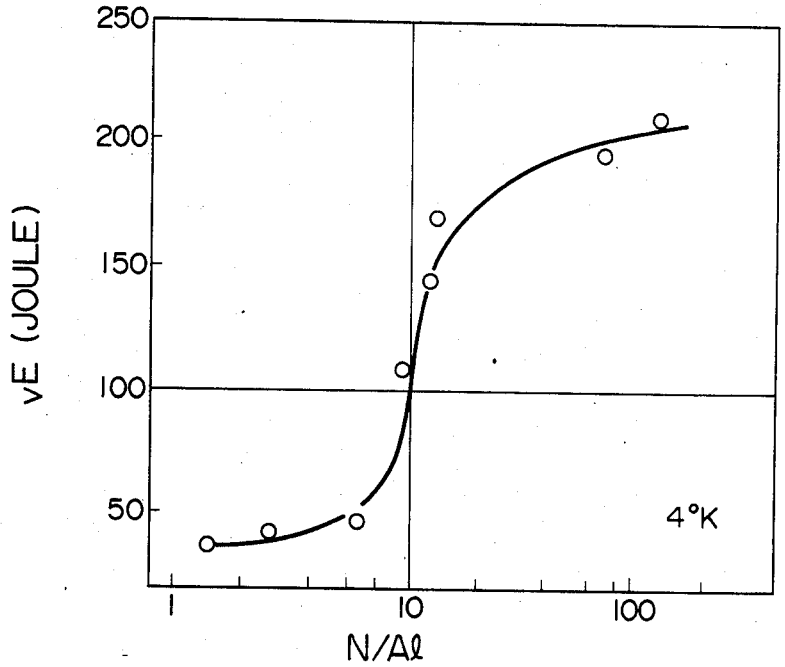
FIG. 5 is a graph showing the relationship between the value of impact energy absorption at 4° K. and the atomic ratio N/Al between nitrogen and aluminum.

Each of stainless steel shown in Table 1 was prepared by use of a vacuum furnace. More specifically, in order to prepare a stainless steel melt of 150 kg in weight regarding each steel, there were charged into the furnace ferro-nickel, ferro-chromium and electrolytic iron each by a predetermined amount calculated from each intended weight percent as to each constituent and such total amount of 150 kg, and there were further charged therein 0.005–0.05% carbon and 0.008–0.37% aluminum. The Al content of 0.008% in the stage of the charging corresponds to about 0.002% of Al contained in stainless steel product, while such 0.37% Al in the charged raw material corresponds to 0.093% Al when formed into stainless steel plate. After the melt-down of the charged raw materials under the argon gas atmosphere of 100 torr in pressure which gas was used for minimizing the boiling of a melt, the gas was exhausted so that vacuum of about $10^{-3}$ torr may be provided in the furnace, the vacuum furnace being then held staionarily in about 40 minutes to effect the deoxidation of the melt mainly through the reaction of carbon, aluminum and oxygen in the melt. Then, nitrogen gas and argon gas were fed in the furnace so that the pressures of nitrogen and argon may be in the ranges of 100–300 torr and of 300–500 torr, respectively. After the sampling and analysis of the melt for confirming the amount of each constituent, silicon, manganese and ferrochromium nitride each of predetermined amount were charged to obtain a final stainless steel melt. The molten stainless steel was cast into an ingot, which was then hot-rolled at a temperature of 1150°–1260° C. to obtain a stainless steel plate of 30 mm in thickness and was solution heat-treated at 1100° C., 1 hr, from which plate were formed test pieces. In the production of the stainless steel of the present invention, raw materials extremely low in sulphur content were selected together with the selection of predetermined low amount of aluminum so that the index of cleanliness may become not more than 0.1%.

Table 1 shows chemical compositions, values of the ratio N/Al, amount of (Cr+0.9 Mn) % and index of cleanliness of various test sample materials. More spcifically, sample Nos. 1 to 8 are steels of the invention, while sample Nos. 9 to 16 are comparison steels. Proof stresses ($\sigma$0.2), tensile strength ($\sigma_B$), Charpy impact energy absorption (vE) and relative magnetic permeability ($\mu$) were measured with these sample test materials at temperatures of 4° K. and 77° K. The result of measurement is shown in Table 2.

TABLE 1

| Samples | | Chemical Compositions C | N | Si | Mn | Cr | Ni | Al | Fe | N/Al | CR + 0.9 Mn (%) | Index of cleanliness (%) |
|---|---|---|---|---|---|---|---|---|---|---|---|---|
| Steels of the present invention | 1 | 0.02 | 0.39 | 0.60 | 0.52 | 25.4 | 13.0 | 0.021 | Bal. | 35.2 | 25.9 | 0.024 |
| | 2 | 0.02 | 0.34 | 0.54 | 1.00 | 27.4 | 17.7 | 0.040 | Bal. | 16.0 | 28.3 | 0.073 |
| | 3 | 0.02 | 0.37 | 0.38 | 0.78 | 25.1 | 13.5 | 0.057 | Bal. | 12.4 | 25.8 | 0.076 |
| | 4 | 0.02 | 0.35 | 0.70 | 11.0 | 16.5 | 14.0 | 0.022 | Bal. | 30.8 | 26.4 | 0.021 |
| | 5 | 0.03 | 0.44 | 0.48 | 13.2 | 19.0 | 9.0 | 0.039 | Bal. | 21.3 | 30.9 | 0.054 |
| | 6 | 0.02 | 0.34 | 0.54 | 4.5 | 22.0 | 17.5 | 0.048 | Bal. | 13.5 | 26.1 | 0.037 |
| | 7 | 0.04 | 0.20 | 0.67 | 1.82 | 21.2 | 11.1 | 0.002 | Bal. | 19.3 | 22.8 | 0.022 |
| | 8 | 0.007 | 0.23 | 0.50 | 1.0 | 20.0 | 11.3 | 0.002 | Bal. | 22.5 | 20.9 | 0.021 |
| Steels for comparison | 9 | 0.04 | 0.02 | 0.82 | 1.42 | 24.6 | 20.2 | 0.012 | Bal. | 3.2 | 25.9 | 0.070 |
| | 10 | 0.04 | 0.18 | 0.61 | 1.79 | 21.2 | 11.1 | 0.039 | Bal. | 8.8 | 22.8 | 0.065 |
| | 11 | 0.03 | 0.37 | 0.26 | 0.59 | 25.4 | 12.9 | 0.040 | Bal. | 17.6 | 25.9 | 0.218 |
| | 12 | 0.03 | 0.18 | 0.72 | 4.0 | 15.0 | 12.1 | 0.054 | Bal. | 6.3 | 18.6 | 0.035 |
| | 13 | 0.09 | 0.32 | 0.84 | 8.0 | 18.0 | 7.5 | 0.061 | Bal. | 10.0 | 25.2 | 0.126 |
| | 14 | 0.03 | 0.46 | 0.60 | 11.0 | 21.5 | 4.7 | 0.046 | Bal. | 19.0 | 31.4 | 0.240 |
| | 15 | 0.04 | 0.42 | 0.62 | 12.4 | 18.8 | 9.5 | 0.085 | Bal. | 9.4 | 30.0 | 0.330 |
| | 16 | 0.034 | 0.373 | 1.00 | 0.56 | 24.3 | 12.9 | 0.093 | Bal. | 8.2 | 24.8 | 0.251 |

TABLE 2

| Sample | | Properties at 4° K. and 77° K. Properties 77° K. $\sigma$0.2 (Mpa) | $\sigma$B (Mpb) | vE (Joule) | $\mu$ | 4° K. $\sigma$0.2 (Mpa) | $\sigma$B (MPa) | vE (Joule) | $\mu$ |
|---|---|---|---|---|---|---|---|---|---|
| Steels of the present invention | 1 | 1131 | 1693 | 238 | 1.004 | 1465 | 1918 | 174 | 1.004 |
| | 2 | 981 | 1589 | 155 | 1.003 | 1395 | 1784 | 139 | 1.002 |
| | 3 | 1002 | 1548 | 139 | 1.017 | 1297 | 1797 | 120 | 1.014 |
| | 4 | 1028 | 1630 | 215 | 1.004 | 1306 | 1885 | 166 | 1.004 |
| | 5 | 1215 | 1715 | 166 | 1.010 | 1488 | 1840 | 141 | 1.008 |
| | 6 | 1030 | 1590 | 145 | 1.003 | 1354 | 1750 | 128 | 1.002 |
| | 7 | 760 | 1530 | 243 | 1.005 | 1006 | 1700 | 210 | 1.004 |
| | 8 | 778 | 1552 | 211 | 1.008 | 1050 | 1745 | 185 | 1.006 |
| Steel for comparison | 9 | 491 | 1023 | 114 | 1.005 | 654 | 1239 | 84 | 1.005 |
| | 10 | (761) | 1346 | 241 | >1.5 | 1170 | 1792 | 75 | >1.5 |
| | 11 | 1029 | 1579 | 63 | 1.015 | 1385 | 1836 | 46 | 1.012 |
| | 12 | 752 | 1317 | 112 | 1.012 | 988 | 1640 | 80 | 1.010 |
| | 13 | 970 | 1540 | 62 | 1.3 | 1335 | 1751 | 47 | 1.3 |
| | 14 | 1230 | 1725 | 58 | >1.5 | 1485 | 1920 | 40 | >1.5 |
| | 15 | 1106 | 1664 | 46 | 1.006 | 1410 | 1880 | 35 | 1.005 |
| | 16 | 985 | 1596 | 62 | 1.003 | 1407 | 1826 | 46 | 1.004 |

As will be seen from Table 2, the sample test materials Nos. 1 to 8 in accordance with the invention showed high values of 0.2% proof stress and high values of impact energy absorptions vE, as well as relative magnetic permability ($\mu$) of not higher than 1.02 showing a stable austenite structure of substantially non-magnetic property, both at 4° K. and 77° K. In contrast, the comparison sample test material No. 9 showed insufficient proof stress due to a too low nitrogen content, as well as a degradation in toughness due to small N/Al value. The comparison sample No. 10 also showed an insufficient proof stress due to a too small nitrogen content and deterioration of toughness attributable to a too small value of N/Al ratio. In addition, this sample showed too high magnetic permeability, proving that the non-magnetic property has been lost. The comparison sample test material No. 11 showed a serious reduction in the toughness due to the index of cleanliness which was as high as 0.218%. The comparison sample test material No. 12 showed insufficient proof stress due to shortage of solid solution amount of nitrogen because of the small (Cr+0.9 Mn) value which was as small as 18.6%, as well as small toughness due to too small value of the ratio N/Al. The comparison sample test material No. 13 exhibited a reduction in toughness which was attributed to a high carbon content in excess of 0.05%, while the comparison sample test material No. 14 suffered from degradation in the non-magnetic property and toughness due to nickel content below 5% and index of cleanliness in excess of 0.1%. Finally, the comparison test sample material Nos. 15 and 16 exhibited reduction in toughness which was attributable to index of cleanliness exceeding 0.1% and N/Al ratio values below 10.

As will be understood from the foregoing description, the invention provides a non-magnetic structural austenitic stainless steel with superior proof stress and toughness at cryogenic temperatures, greatly contributing to the improvement in the fields of industry concerned.

What is claimed is:

1. A structural austenitic stainless steel with superior proof stress and toughness at cryogenic temperatures having a composistion consisting of, by weight, not greater than 0.05% of carbon, 0.20 to 0.70% of nitrogen, not greater than 1.0% of silicon, not greater than 25% of manganese, 13 to 35% of chromium, 5 to 25% of nickel and the balance iron and incidental impurities, the chromium content and manganese content being selected to meet the condition of $(Cr+0.9\ Mn)\geqq 20\%$, the index of cleanliness showing the amount of non-metallic inclusions being not greater than 0.1%.

2. A structural austenitic stainless steel with superior proof stress and toughness at cryogenic temperatures according to claim 1, wherein a proof stress thereof is not smaller than 1000 Mpa at 4° K. and a V-notch Charpy impact energy absorption is not smaller than 100 Joule at 4° K.

3. A structural austenitic stainless steel with superior proof stress and toughness at cryogenic temperatures according to claim 2, wherein a proof stress thereof is not smaller than 700 Mpa at 77° K. and a V-noth Charpy impact energy absorption thereof not smaller than 120 Joule at 77° K.

4. A structural austenitic stainless steel with superior proof stress and toughness at cryogenic temperatures according to claim 1, wherein a relative magnetic permeability thereof is not greater than 1.02.

5. A structural austenitic stainless steel with superior proof stress and toughness at cryogenic temperatures according to claim 1, wherein the manganese content thereof ranges between 1 and 15%.

6. A structural austenitic stainless steel with superior proof stress and toughness at cryogenic temperatures having a composition consisting, by weight, of not greater than 0.05% of carbon, 0.20 to 0.70% of nitrogen, not greater than 1.0% of silicon, not greater than 25% of manganese, 13 to 35% of chromium, 5 to 25% of nickel, not greater than 0.07% of total aluminum, and the balance iron and incidental impurities, the chromium content and manganese content being selected to meet the condition of $(Cr+0.9\ Mn)\geqq 20\%$, the atomic ratio N/Al between nitrogen and aluminum being not smaller than 10, the index of cleanliness showing the amount of non-metallic inclusions being not greater than 0.1%.

7. A structural austenitic stainless steel with superior proof stress and toughness at cryogenic temperatures according to claim 6, wherein a proof stress thereof is not smaller than 1000 Mpa at 4° K. and a V-notch Charpy impact energy absorption thereof is not smaller than 100 Joule at 4° K.

8. A structural austenitic stainless steel with superior proof stress and toughness at cryogenic temperatures according to claim 6, wherein a proof stress thereof is not smaller than 700 Mpa at 77° K. and a V-notch Charpy impact energy absorption thereof is not smaller than 120 Joule at 77° K.

9. A structural austenitic stainless steel with superior proof stress and toughness at cryogenic temperatures according to claim 6, wherein a relative magnetic permeability thereof is not greater than 1.02.

10. A structural austenitic stainless steel with superior proof stress and toughness at cryogenic termperatures according to claim 6, wherein the manganese content thereof ranges between 1 and 15%.

* * * * *